US007984675B2

(12) United States Patent
O'Dwyer

(10) Patent No.: US 7,984,675 B2
(45) Date of Patent: Jul. 26, 2011

(54) PROPELLANT SEALING SYSTEM FOR STACKABLE PROJECTILES

(75) Inventor: Sean P. O'Dwyer, Queensland (AU)

(73) Assignee: Metal Storm Limited, Queensland (AU)

( * ) Notice: Subject to any disclaimer, the term of this patent is extended or adjusted under 35 U.S.C. 154(b) by 7 days.

(21) Appl. No.: 12/201,454

(22) Filed: Aug. 29, 2008

(65) Prior Publication Data

US 2010/0282111 A1 Nov. 11, 2010

Related U.S. Application Data

(63) Continuation-in-part of application No. 12/280,108, filed as application No. PCT/AU2007/000184 on Feb. 21, 2007, now Pat. No. 7,743,705.

(30) Foreign Application Priority Data

Feb. 21, 2006 (AU) ..... 2006900844

(51) Int. Cl.
*F42B 12/58* (2006.01)

(52) U.S. Cl. ..... 102/438; 102/217; 102/439; 89/135

(58) Field of Classification Search ..... 102/380, 102/381, 438, 439, 217, 374, 376, 472; 89/127, 89/135

See application file for complete search history.

(56) References Cited

U.S. PATENT DOCUMENTS

| | | | | |
|---|---|---|---|---|
| 694,896 | A | 3/1902 | Scott | |
| 2,009,993 | A | 11/1937 | Tauschek | |
| 3,139,795 | A | 7/1964 | Altschuler | |
| 3,815,271 | A | 6/1974 | Lynn | |
| 4,285,153 | A * | 8/1981 | Crouch | 42/84 |
| 6,722,252 | B1 | 4/2004 | O'Dwyer | |
| 7,373,884 | B2 | 5/2008 | Haeselich | |

(Continued)

FOREIGN PATENT DOCUMENTS

| | | |
|---|---|---|
| WO | WO-2004/070307 | 8/2004 |

(Continued)

OTHER PUBLICATIONS

"PCT International Search Report—PCT/AU2007/000184—Filed Feb. 21, 2007—7 pgs.", (Apr. 16, 2007).

*Primary Examiner* — J. Woodrow Eldred
*Assistant Examiner* — Gabriel J Klein
(74) *Attorney, Agent, or Firm* — Diehl Servilla LLC

(57) ABSTRACT

A projectile for use in a barrel with stacked projectiles, particularly for a weapon which can be reloaded by a user in the field. The projectile includes a chamber containing a propellant charge, with an exit from the chamber for release of propulsion gases into the barrel. A seal blocks the exit and is opened by ignition of the propellant within the chamber but is resistant to gases produced by ignition of propellant in other projectiles in the barrel. The exit and seal are provided in a range of different forms. The exit may be an aperture in a wall of the chamber with the seal as a moveable barrier, such as a valve-like structure, for example. The seal may also include a rupturable or deformable barrier across the aperture. Alternatively the seal is a thin barrier around the charge such as a wax coating and the exit involves a disintegrable character of the barrier. The seal may also be an inherent property of the geometry of the chamber.

11 Claims, 15 Drawing Sheets

U.S. PATENT DOCUMENTS

| | | | |
|---|---|---|---|
| 7,451,702 | B1 | 11/2008 | Dindl et al. |
| 7,464,649 | B2 | 12/2008 | Bishop et al. |
| 7,475,636 | B2 | 1/2009 | O'Dwyer et al. |
| 2003/0127010 | A1 | 7/2003 | O'Dwyer |
| 2004/0231219 | A1 | 11/2004 | O'Dwyer |
| 2005/0268807 | A1 | 12/2005 | Bambach |
| 2007/0056460 | A1 | 3/2007 | O'Dwyer et al. |

FOREIGN PATENT DOCUMENTS

| | | |
|---|---|---|
| WO | WO-2004/097326 | 11/2004 |

* cited by examiner

PROPELLANT SEALING SYSTEM FOR STACKABLE PROJECTILES

CROSS-REFERENCE TO RELATED APPLICATIONS

This application is a continuation-in-part of U.S. patent application Ser. No. 12/280,108, filed on Aug. 20, 2008, which is a 35 U.S.C. §371 filing of International Application No. PCT/AU2007/000184, filed on Feb. 21, 2007,which claims the benefit under 35 U.S.C. §119 of AU2006900844, filed on Feb. 21, 2006, each of which is incorporated by reference thereto in its entirety.

FIELD OF THE INVENTION

This invention relates to systems for sealing of propellant charges in relation to stackable projectiles, particularly to a system for sealing of a propellant charge inside a projectile to prevent ignition of the charge by gases resulting from ignition of the leading projectiles in the stack. More particularly the invention relates to projectiles which may be loaded into a barrel assembly in the field.

BACKGROUND OF THE INVENTION

A wide range of sealing systems have been developed for weapons having stacked projectile arrangements or barrel assemblies, such as the "wedging" systems described in WO 94/20809 and WO 97/04281, and the "projectile-to-projectile" sealing arrangements which in WO 03/089871, for example. The projectiles in these weapons are generally caseless and temporary seals are therefore required to prevent blow-back of ignition gases down the barrel. If no sealing system is present, hot pressurised gases from ignition of a leading projectile in a stack will usually cause uncontrolled ignition of the propellant in a trailing projectile.

Wedging systems generally form seals by interaction between successive projectiles in a stack. An axial force down the barrel causes the interaction either when the stack is loaded in a barrel or when projectiles are fired from the barrel, or both. The interaction causes a collar or tail on each projectile to expand into tight contact with the bore of the barrel, preventing blow-back past that point. Depending on the pressures involved, the expanding part of each projectile is typically a soft metal or plastic which deforms into a circumferential contact with the barrel. Various "forward", "reverse", "nose-to-tail" and "stick" systems have been developed.

Weapons that use wedging systems can be difficult for a user in the field to reload and generally require loading in a factory or other specialised environment. A large force is usually required to form the seal and the surfaces that interact within the barrel must be sufficiently clean. Special tools may be required. Subsequent shocks or vibration may weaken the seals and reduce the reliability of the weapons. Long cartridges containing pre-stacked projectiles are used for reloading in the field, but when partially empty these may be problematic for the user.

Systems that utilise projectile-to-projectile sealing form seals by interaction between successive projectiles. These also are not generally suitable for reloading in the field.

SUMMARY OF THE INVENTION

It is therefore an object of the invention to provide an improved sealing system for stacked projectiles, or at least to provide an alternative to existing systems.

In one aspect the invention may be said to reside in a projectile for use in a barrel with stacked projectiles, including: a chamber containing a propellant charge for the projectile, an exit from the chamber for release of propulsion gases into the barrel when the propellant is ignited, and a seal blocking the exit which is opened by ignition of the propellant within the chamber but is resistant to gases produced by ignition of propellant in other projectiles in the barrel.

In one embodiment the exit is an aperture in a wall of the chamber and the seal is a moveable barrier in the aperture, such as a valve-like structure. In another embodiment the exit is an aperture in a wall of the chamber and the seal is a rupturable barrier across the aperture. In a further embodiment the seal is a deformable barrier across the aperture. In a still further embodiment the seal is a thin barrier around the charge such as a bag, wrapping or coating and the exit involves a disintegrable character of the barrier. In a further embodiment the seal is an inherent property of the geometry of thee chamber.

Preferably the seal not only resists gases produced by ignition of other projectiles in the barrel, but the action of the seal is also enhanced by the pressure of the gases. In the case of a seal formed by a moveable barrier for example, the gas pressure may urge the barrier into still closer contact with adjacent parts of the chamber.

Preferably the opening of the seal in a projectile does not create debris which might impede the passage of subsequent projectiles inside the barrel. In the case of a seal formed by a rupturable barrier for example, the ruptured portions of the barrier remain attached to the chamber and are carried out of the barrel by the projectile. In the case of a seal having a disintegrable character, the seal should be largely or entirely destroyed or consumed when the propellant inside the chamber is ignited.

In another aspect the invention resides in a sealing system for a propellant charge, including: a container for the charge, and exit means for release of combustion gas from the container when the charge is ignited, wherein the exit means is opened by ignition of the charge within the chamber but is resistant to ignition of charges outside the container.

Preferably the container is a chamber formed in a larger structure such as a projectile or barrel assembly. The exit means is typically an aperture that is closed by a moveable, rupturable or deformable barrier. Alternatively the container may be a relatively thin barrier around the charge such as a bag or wrapping, and the exit means includes rupture, burning or other disintegration of the barrier. The sealing may also be an inherent property of the chamber.

The invention also resides in a barrel assembly containing stacked projectiles with independent sealing as defined above, and in methods of loading and firing projectiles having sealing systems as indicated above.

These sealing systems can function to isolate propellant charges independently of other sealing interactions between adjacent projectiles or between projectiles and the barrel. A sealing action of this kind will assist the design of stacked weapons which are individually reloadable.

The invention also resides in any alternative combination of features that are indicated in this specification. All equivalents of these features are deemed to be included whether or not explicitly set out.

BRIEF DESCRIPTION OF DRAWINGS

Embodiments of the invention will be described with respect to the accompanying drawings, of which.

DESCRIPTION OF PREFERRED EMBODIMENTS

Figure 1:
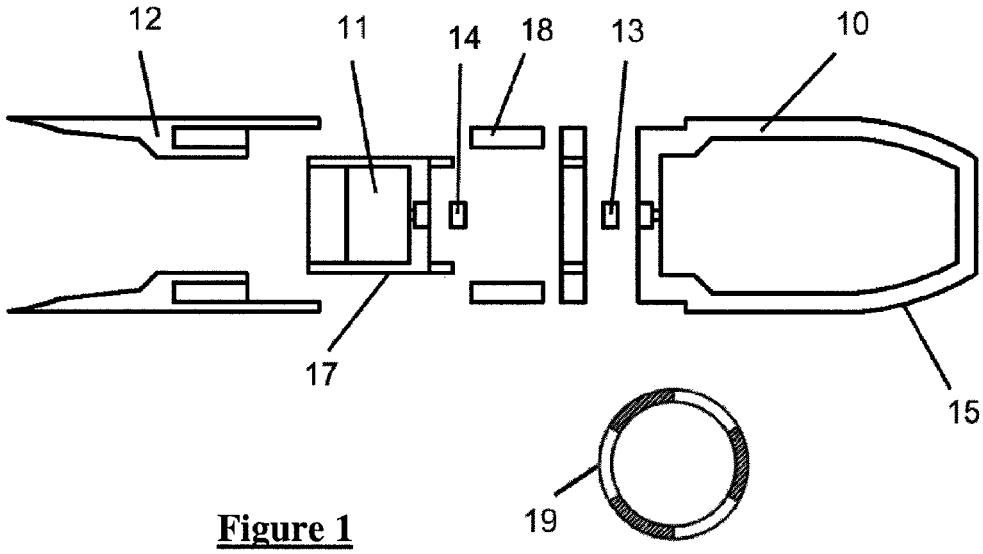
FIG. 1 shows a stackable projectile having a generalised burner system.

Referring to the drawings it will be appreciated that the invention may be implemented in a range of different ways for a range of different projectiles and barrel assemblies. These embodiments are given by way of example only, and are not intended to limit the remainder of the disclosure in any way. Systems related to the weapon which fires the projectiles will appreciated by a skilled person and need not be described in detail.

FIG. 1 shows a typical projectile for a stacked projectile weapon, in a cross sectional exploded form. The projectile includes a payload container 10, such as a warhead, a propellant charge 11, and a tail assembly 12. Primer 13 activates the warhead and primer 14 ignites the propellant. The projectile is adapted to be stackable nose to tail with a number of identical projectiles in the barrel of the weapon. Nose portion 15 has a roughly convex outer surface shaped to correspond with a roughly concave inside surface of the tail assembly. Various other features may also be provided, such as driving bands which improve the efficiency of firing, and a system for connecting the projectiles together.

Because the projectile in FIG. 1 is to be used in a stack the propellant must be sealed against ignition gases which fill the barrel of the weapon after each projectile is fired. In this example the propellant is sealed within a burner or casing 17 which is resistant to the ignition gases produced by other projectiles. The casing provides a chamber and typically includes a seal portion which moves, ruptures, deforms, disintegrates or otherwise opens under the higher pressures inside the casing which are produced when propellant 11 is ignited. However, the seal is either unaffected or is enhanced by an increase in pressure outside the casing. A range of other systems such as wedge sealing between projectile and barrel, or between nose and tail of adjacent projectiles, may be employed in addition to the internal casing system.

In FIG. 1 the projectile is fired from the weapon by way of an inductive system having an inductor 18 which interacts with a corresponding inductor in the barrel, and a signal detector 19 which receives output from the inductor 18 and determines whether the projectile is required to fire. The detector is typically programmed with a code and on receiving a signal containing the code from the inductor, the detector triggers the primer 14 to ignite the propellant. The detector may also arm the warhead and enable primer 13. Otherwise the detector generally remains idle. Firing systems of this kind are known and need not be described in detail. A range of other electrical or mechanical firing systems are also possible for stacked projectile weapons.

Figure 2A:
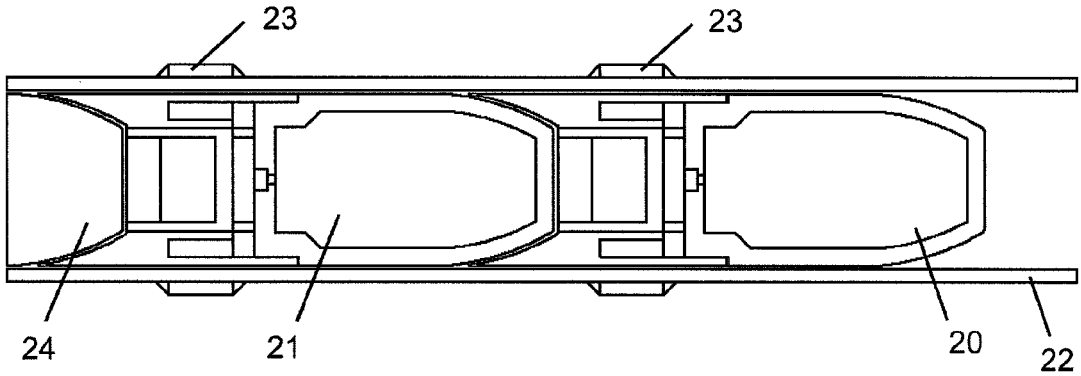
FIGS. 2*a*, 2*b* show how propellant gases typically flow in a barrel when a stacked projectile is fired.
Figure 2B:
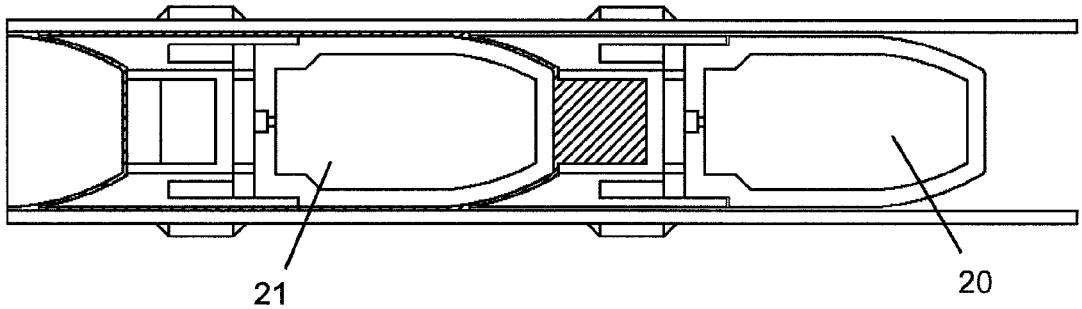

FIGS. 2*a, b* indicate how propellant gases are typically distributed in the barrel of a stacked projectile weapon, particularly a weapon which is designed to be reloaded or unloaded in the field. Tolerances between the projectiles and the bore of the barrel are generally large enough to enable a sliding fit of projectiles into the bore. Projectiles 20 and 21 are leading and trailing projectiles respectively, stacked nose to tail in barrel 22. Inductors 23 outside the barrel interact with corresponding inductors in the projectiles to initiate the firing process. A breech plug 24 supports projectile 21 at the base of the stack. The projectiles fit closely within the barrel, and usually include driving bands, but there is generally enough tolerance within the bore of the barrel for hot, high pressure propellant gas from a leading projectile to circulate past trailing projectiles when the leading projectile is fired. In FIG. 2*b* the gas (shaded) from ignition of propellant in the burner of projectile 20 blows backwards down the barrel past the body of projectile 21 and reaches the outside surface of burner in projectile 21. Without sealing, there is a tendency for ignition of the propellant in projectile 21.

Figure 3A:
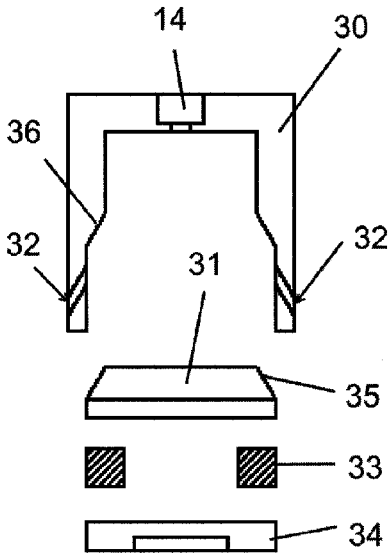
FIGS. 3*a-d* show a burner system with a moveable seal.
Figure 3B:
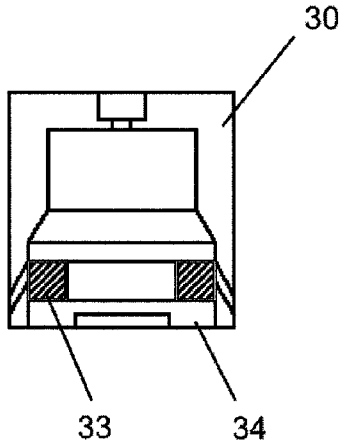
Figure 3C:
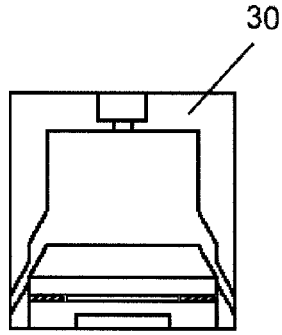

FIGS. 3*a-d* shows a burner system suitable for use as the burner 17 in FIG. 1, in order to provide sealing against ignition of the propellant by other projectiles in a stack. The burner includes a generally cylindrical casing 30 and moveable slab 31 which encase the propellant. Exit vents 32 around the casing are normally blocked by the slab and prevent ignition gases produced by other projectiles from entering the casing. The slab has an edge face 35 which abuts a corresponding face 36 inside the casing 30 to assist the seal. An increased pressure caused by gases outside the casing serves to compress the faces 35 and 36 together more closely. A spring 33 and retainer 34 hold the slab in place within the casing as shown in FIG. 3*b*. When fired, the spring is compressed or crushed by the slab and the ignition gases produced within the burner are able to escape, as shown in FIG. 3*c*. The projectile is then propelled by gas pressure within the barrel.

Figure 3D:
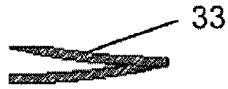

A section though a coil spring 33 is shown in FIG. 3*d* is shown as an example, although other spring types such as a disc spring or belleville washer could be suitable. Gases outside the casing 30 are able to more freely through the spring.

Figure 4A:
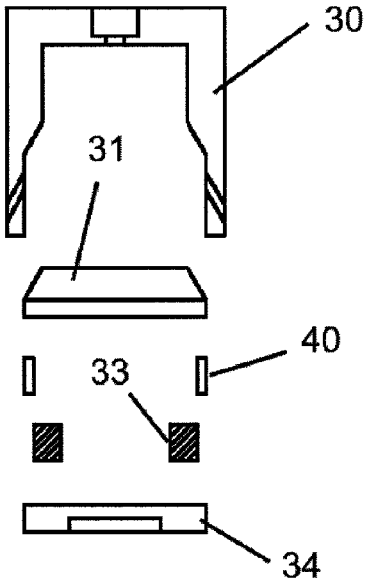
FIGS. 4*a-d* show a variation on the burner in FIG. 3, FIGS. 4*e-g* show a further variation, FIGS. 5*a, b* show a further variation on the burner in FIG. 3, FIGS. 6*a-c* show a further burner with a moveable seal.
Figure 4B:
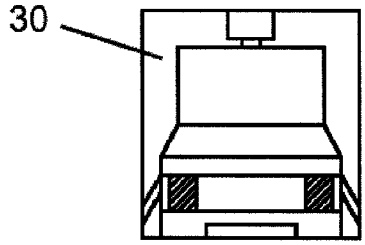
Figure 4C:
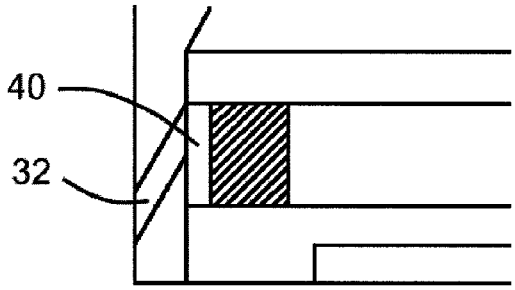
Figure 4D:
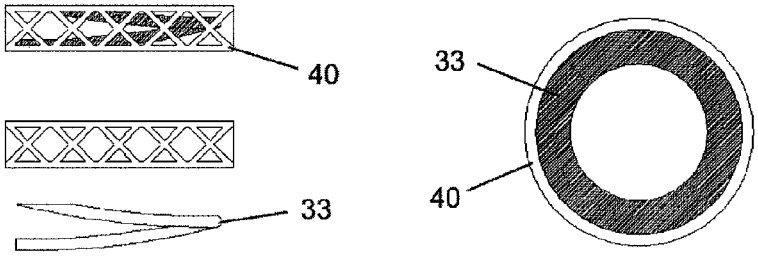

FIGS. 4*a-d* show a variation on the burner system in FIGS. 3*a-d*. The system now includes a crush ring 40 which prevents the slab 31 from compressing the spring 33 until a predetermined pressure has been reached inside the casing. This ensures that on ignition of the propellant inside the casing, the resulting gases burn cleanly and are not released into the barrel to propel the projectile until the predetermined pressure has been reached. The ring 40 may take a range of structures and operate in a range of different ways. FIG. 4*d* shows a circular grill structure which contains the spring 33 and allows throughflow of gas, by way of example.

Figure 4E:
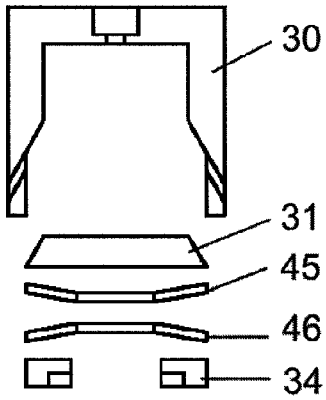
Figure 4F:
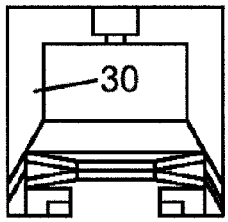
Figure 4G:
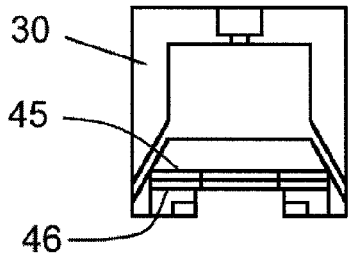

FIGS. 4*e-g* show a further variation on the burner system in FIGS. 3*a-d*. The system now includes a sprung disc 45 such as a belleville washer between slab 31 and the retaining ring 34. In this example, a second disc 46 has also been included with an orientation which is inverted relative to disc 45. As in FIGS. 4*a-d* the discs compress the slab inwards to form a seal with the casing until a predetermined pressure has been reached inside the casing. FIG. 4*g* shows the burner after ignition of the propellant and opening of the seal. The discs 45, 46 have been crushed into a flat configuration.

Figure 5A:
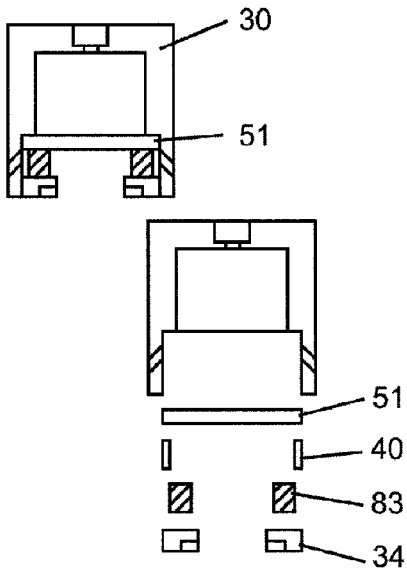
Figure 5B:
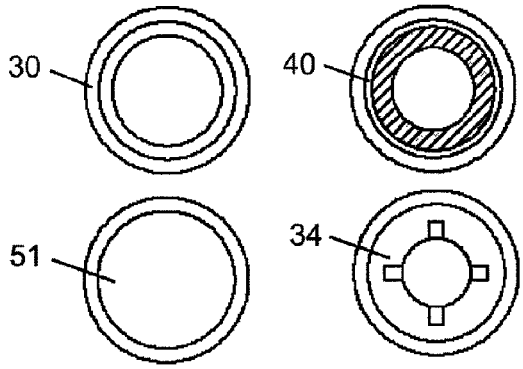

FIGS. 5*a, b* show a further variation on the burner system in FIGS. 3*a-d*. Slab 31 in FIG. 3*a* takes the form a disc with a bevelled edge which abuts a corresponding surface of the casing, effectively forming a wedge. Slab 51 is a simple disc shape without the bevel. Both slabs seal against a flange inside the casing to prevent entry of gases from the barrel and the greater the external pressure the stronger the sealing action. The slab 51 in FIG. 5*a* is considered to be less effective in forming a seal with the casing than the slab 31 in FIG. 3*a*. FIG. 5*b* shows a series of underside views of the casing with the slab 51, a crush ring 40 and retainer 34 in place.

Figure 6A:
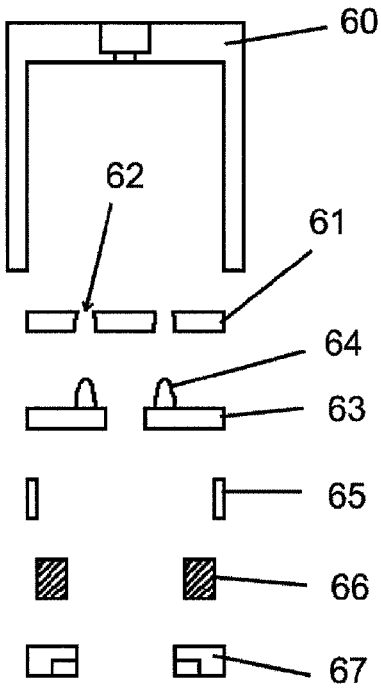
FIGS. 6*d-f* show a further variation.
Figure 6B:
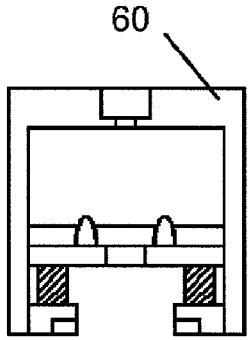
Figure 6C:
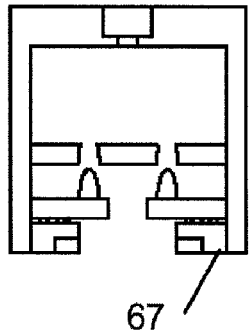

FIGS. 6*a-c* show a further alternative to the burner system in FIGS. 3*a-d*. In this system the casing 60 contains a panel 61 with two or more vents 62. A moveable slab 63 includes corresponding keys 64 which occupy the vents and seal propellant inside the casing. A crush ring 65, spring 66 and retainer disc 67 are provided as before. External pressure caused by ignition gases outside the casing urges the keys further into the vents to improve the sealing action. On ignition of propellant inside the casing, the keys are forced out of the vents and the slab compresses the ring 65 and spring 66. FIGS. 6*b* and 6*c* show the casing before and after firing of the propellant respectively.

Figure 6D:
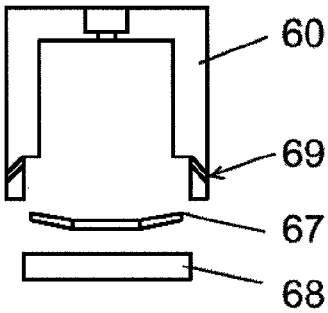
Figure 6E:
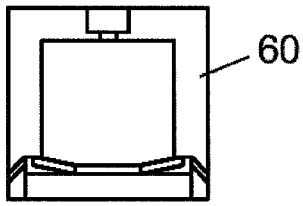
Figure 6F:
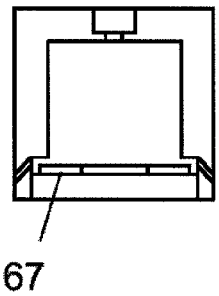

FIGS. 6*d-f* show a further alternative burner system. In this system a seal with the casing is provided by a sprung disc 67, typically a belleville washer, located on a slab 68 which is typically threaded into the casing. The edges of the disc abut the casing to prevent flow of external ignition gases into the casing 60 through vents 69. The crush resistance of the disc is calculated to provide a predetermined internal pressure at which the disc is distorted and ignition gases produced inside the casing are released.

Figure 7A:
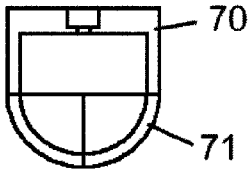
FIGS. 7*a-c* show a burner system with a pivoting seal.
Figure 7B:
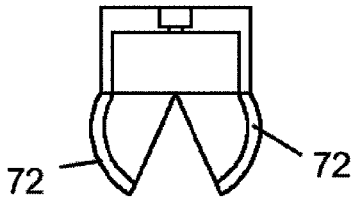
Figure 7C:
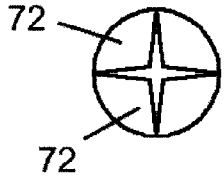

FIGS. 7*a-c* show a further alternative burner having a moveable seal, suitable for use as the burner 17 in FIG. 1. In this example the burner has a casing 70 and a moveable seal 71 in a flower form having leaves 72. Gas pressure outside the burner serves to maintain the leaves together while ignition of propellant inside forces the leaves to open. Once again the stronger the gas pressure outside the casing 70 the stronger the sealing action of the leaves. A range of different valve seals of this general kind may be envisaged. FIGS. 7*b* and 7*c* show the leaves in an open position.

FIGS. 8*a-d* show an alternative burner having a rupturable seal, also suitable for use as the burner 17 in FIG. 1 to resist blow-back of external propellant gases. The burner includes a generally cylindrical casing 80 which contains propellant, and a series of metal discs which form a closure for the casing. Vent disc 81 includes four vents 82 while burst disc 83 includes corresponding sealing portions 84 which cover the vents. The number and arrangement and cross sectional shape and area of the vents 82 may be selected to throttle the venting of the propellant gases to ensure a complete and controlled propellant burn. A complete and controlled burn is important for predictable muzzle velocity of the projectile. An annular spacer may be provided between the vent disc 81 and the burst disc 83 so that propellant gas pressure can act across more of the inner surface of the burst disc 83 prior to bursting. Alternatively, the vent disc 81 may have its outer surfaces machined to reduce the thickness of the vent disc 83 adjacent to the vents 82. Machining of the vent disc 81 may extend to the nominal internal diameter of the cylindrical casing 80.

A retainer ring 85 holds the discs within the casing and provides openings 86 to allow the burst disc to operate. Casing 80 is counter bored to form a shoulder against which the vent disk 81 seats. Retainer 85 threadably engages the counter bored portion of the inner wall of the casing 80 and sealingly clamps the vent disc 81 and burst disc 83 against the shoulder. Vent disc 81 may be omitted whereby the burst disc 81 or annular spacer seat and seal against the shoulder. The outer surface of the retainer 85 may include features to engage a tool for threading the retainer to the casing 80. Retainer 85 of FIG. 8 for example has four slots for engaging a Philips head type tool. In another example a central opening 86 may be hexagonal to engage a hexagonal key.

Figure 8A:
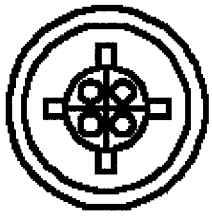
FIGS. 8*a-d* show a burner with a rupturable seal, FIGS. 9*a, b* show a variation of the burner in FIG. 8*a-d,*
Figure 8B:
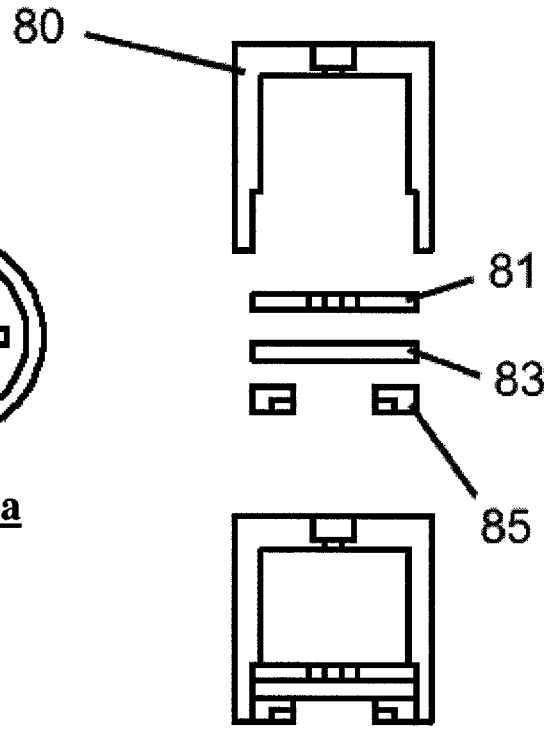
Figure 8C:
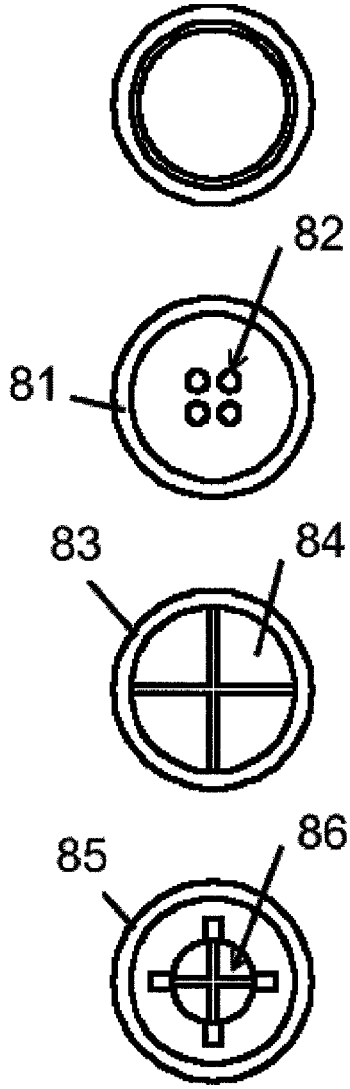
Figure 8D:
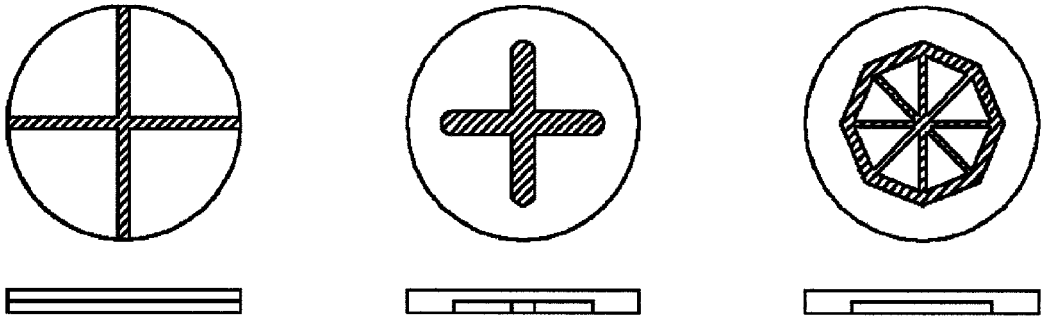

Pressure from ignition gases external to the casing is reduced by the overall volume available in the barrel, and is resisted by the burst disc 83. However, pressure caused by combustion of the propellant inside the casing causes the disc 83 to rupture, releasing gases which propel the respective projectile. The burst disc 83 is scored or otherwise constructed in a way which ruptures in a predictable fashion, generally at or above a predetermined pressure and/or temperature, and leaves no significant debris in the barrel of the weapon. The width, length, depth and cross sectional shape, including radiuses, of each score is selected for a selected burst disc material to achieve the desired burst pressure. The number and interaction of scores is also selected to achieve the desired burst pressure and throttling of the propellant burn. FIG. 8*d* shows several scoring patterns, by way of example. Each pattern provides a selected throttling of the venting of the propellant gases. The size of the throttle required will vary depending on variables including volume and type of propellant which are selected depending on e.g. mass of the projectile, desired muzzle velocity and spin rate, barrel length etc.

Figure 9A:
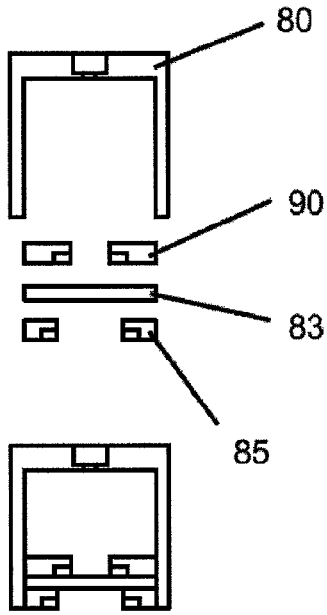
FIGS. 9*c-e* show a further variation.
Figure 9B:
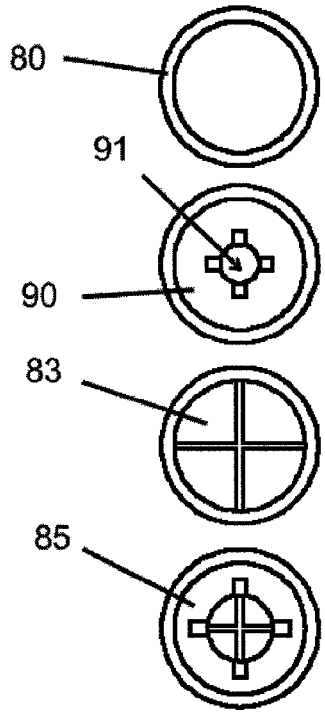

FIGS. 9*a, b* show a variation on the rupturable burner in FIGS. 8*a-d*. In this example, the vent disc 90 includes a single central aperture 91 as the vent. The remaining components are substantially similar to the previous example. Burst disc 83 and retainer 85 are provided as a seal over the vent disc with the retainer typically being threaded into the casing to hold the burst disc in place. As described above for FIG. 8, the aperture 91 may be hexagonal to engage a hexagonal key for rotating the retainer 85. Various structures of this kind are envisaged to enable accurate tailoring of the burner system to suit particular projectile types and environments. Such burners as described in, e.g., FIGS. 8 and 9 are simple and hence cost effective to manufacture and readily varied to suit the application.

Figure 9C:
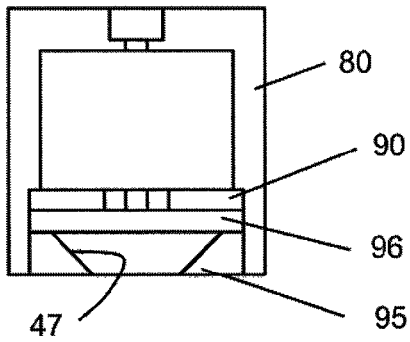
Figure 9D:
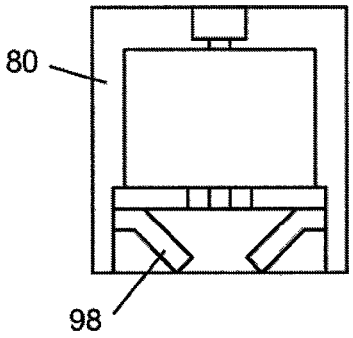
Figure 9E:
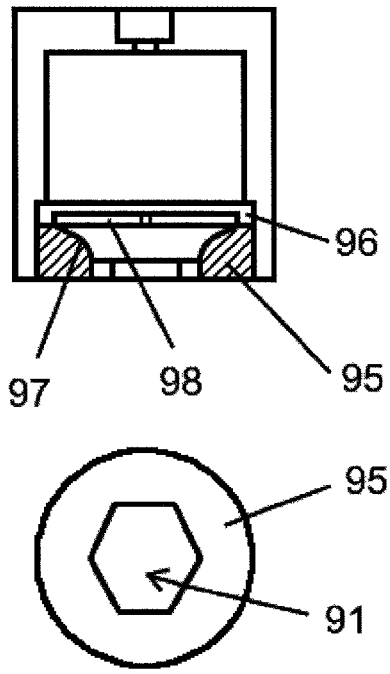

FIGS. 9*c-e* show a further variation on the rupturable burner in FIGS. 8*a-d*. As described above for FIG. 8, the vent disc 90 may be omitted. In this system the retainer 95 cooperates with the burst disc 96 to reduce the likelihood that debris will be left in the barrel after the respective projectile has been fired. The retainer takes the form of an annulus or ring as before, but the inner edge 97 of the ring is sloped or otherwise shaped to provide a supporting stop for the sealing portions 98 of the burst disc. The sealing portions are scored to bend or break from the burst disc and their movement away from the vents 82 is limited by the inner edge of the retainer. The sealing portions contact the sloped surface of the retainer and are stopped before they break free of the burst disc. This also ensures that the desired throttle is formed by the burst disc. The dimensions and shape of the inner edge 97 are selected to achieve the desired throttling. The inner and outer diameters, the radiuses at the edges of the inner and outer diameters as well as the angle of the slope of the edge 97 can be varied. FIGS. 9*c* and 9*d* show the inner edge 97 having a straight slope. The slope may be curved, as shown in FIG. 9*e* to achieve the desired throttle. Again, the aperture 91 may be hexagonal to engage a hexagonal key for rotating the retainer 85.

Figure 10A:
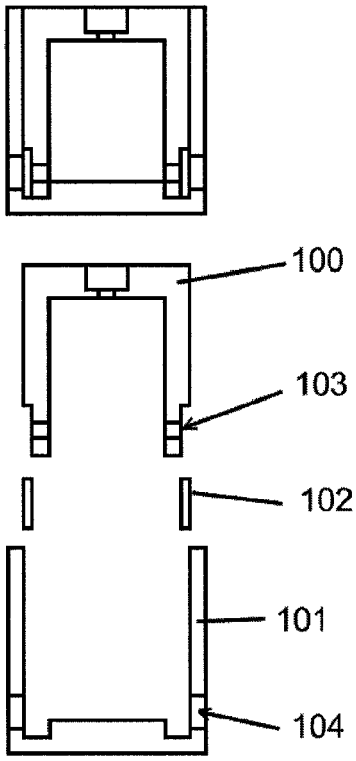
FIGS. 10*a, b* show a further burner with a rupturable seal.
Figure 10B:
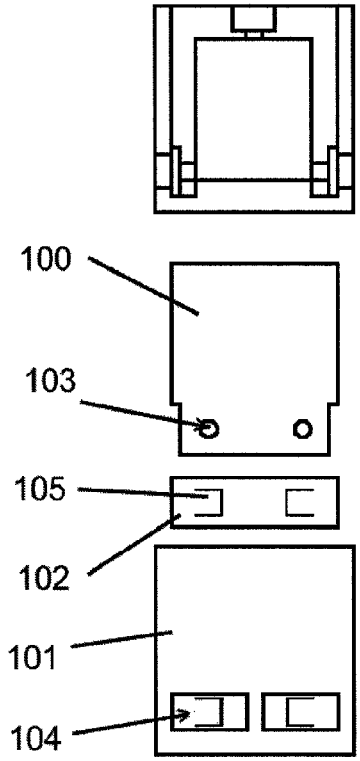

FIGS. 10*a, b* show an alternative to the rupturable burner in FIGS. 8*a-d*. A casing 100 and jacket 101 fit together to enclose a burst ring 102. The casing and jacket include vents 103 and 104 respectively which have corresponding seal portions 105 on the burst ring. An indent at the foot of the casing creates the enclosure for the burst ring. In this example the ring is simply a band of a suitably composed metal or non-metallic substance. External pressure caused by ignition gases from leading projectiles in the stack is resisted by the seal portions. Internal pressure arising from ignition of propellant within the casing causes the seal portions to rupture outwards, releasing gas into the barrel to propel the projectile.

Figure 11A:
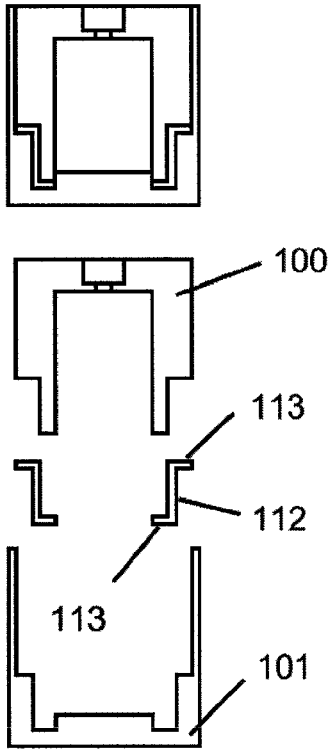
FIGS. 11*a, b* show a variation on the burner in FIG. 10.
Figure 11B:
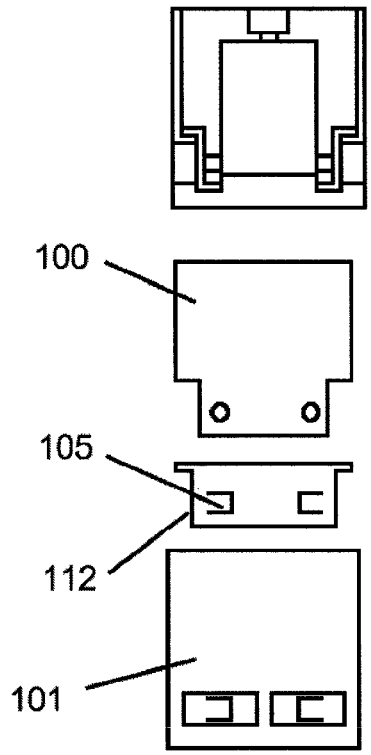

FIGS. 11*a, b* show a variation on the burner in FIGS. 10*a, b*. In this example the burst ring 112 has a pair of flanges 113 which clamp the ring in place between the casing 110 and the jacket 111. These flanges assist the sealing action of the burst ring inside the casing.

Figure 12A:
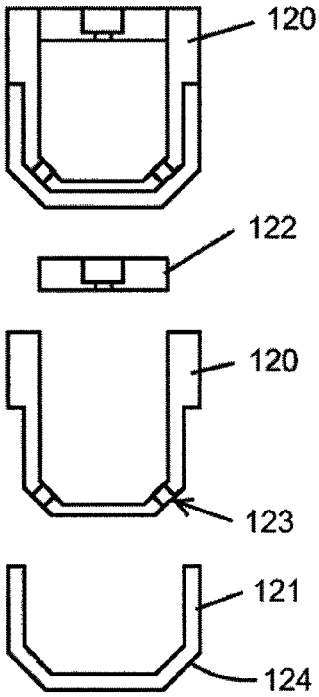
FIGS. 12*a, b* show a further burner with a rupturable seal.
Figure 12B:
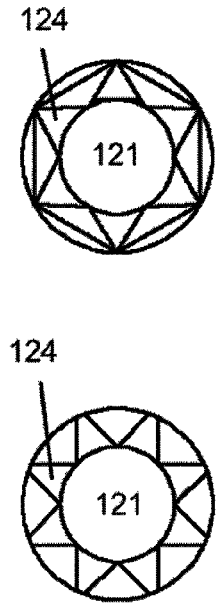

FIGS. 12*a, b* show a further rupturable burner system. A casing 120 is surrounded by burst jacket or sleeve 121. A disc 122 closes the casing once propellant has been loaded. The casing includes vents 123 which are sealed by respective portions 124 in the jacket. FIG. 12*b* shows typical scoring patterns on the jacket, arranged in correspondence with the vents 123. External pressure caused by ignition gases from leading projectiles in the stack is resisted by the jacket. Internal pressure arising from ignition of propellant within the casing causes the jacket to rupture outwards in the vicinity of the vents, releasing gas into the barrel to propel the projectile.

Figure 13A:
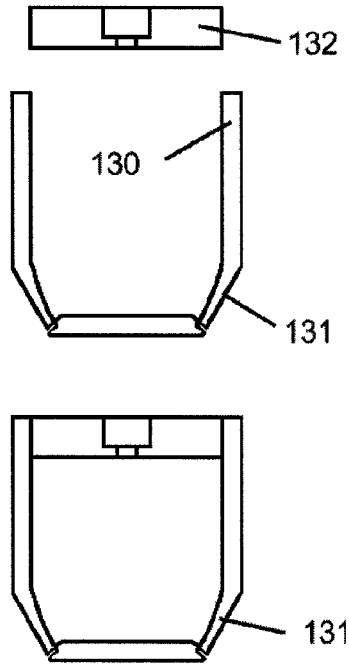
FIGS. 13*a-c* show a further burner with a rupturable seal.
Figure 13B:
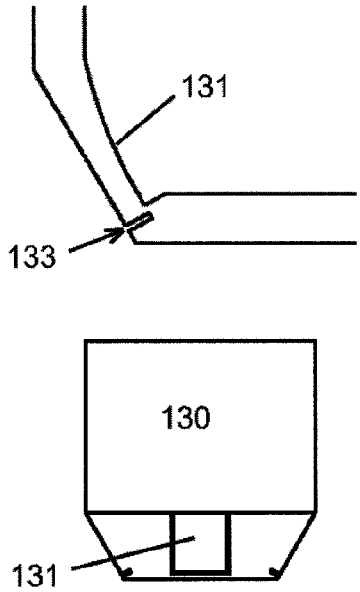
Figure 13C:
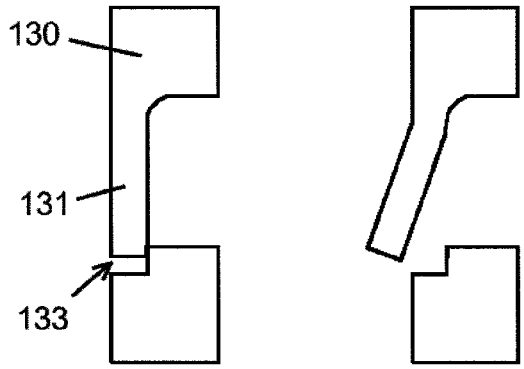

FIGS. 13*a, b* show a further rupturable burner system in which the casing 130 itself includes rupture portions 131. A disc 132 closes the casing once propellant has been loaded. Each portion 131 is formed as an approximately U shaped area surrounded by a channel 133 or otherwise asymmetrically weakened structure in the casing. The detailed structure of the rupture portions is intended to break more readily under outward rather than inward pressure, as an inherent property of the geometry of the chamber. Multiple rupture portions are formed around a circumference in the casing. The seal which is effectively formed by the casing itself is broken when pressure inside the casing rises after ignition of the propellant, but remains unbroken by relatively lower pressures outside the casing caused by ignition of the other propellant in the barrel. FIG. 13*c* shows the structure and rupture action of the casing in more detail.

Figure 14A:
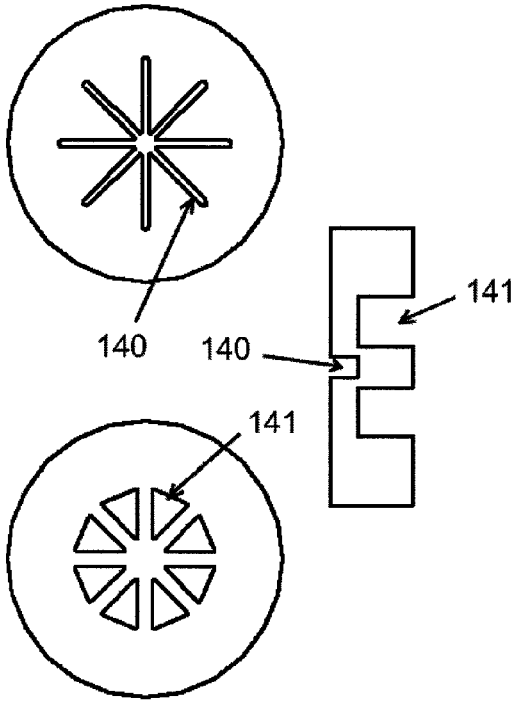
FIGS. 14*a, b* show rupture details for FIGS. 13*a-c,*
Figure 14B:
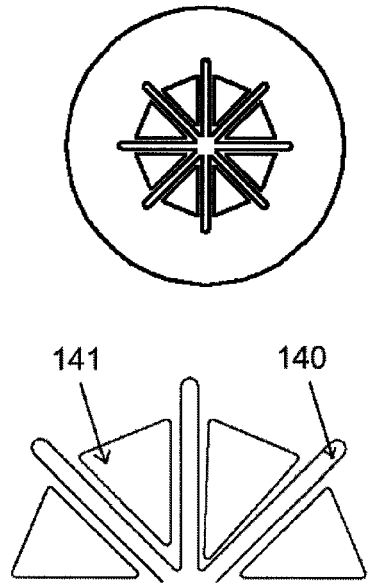

FIGS. 14*a, b* show alternative scoring patterns for the casing in FIGS. 13*a, b*. In FIG. 14*a* a pattern of grooves 140 have been formed on the outside surface of the casing, in relation to a pattern of cavities 141 on the inside surface. The patterns are symmetrical around the cylindrical axis of the casing in this example. Relatively thin portions of material 142 inside the casing between the grooves lines and cavities are intended to rupture more readily in an outwards direction under pressure of ignition gases inside the burner. The geometry of the score lines and cavities is indicated in see-through view of FIG. 14*b*.

Figure 15A:
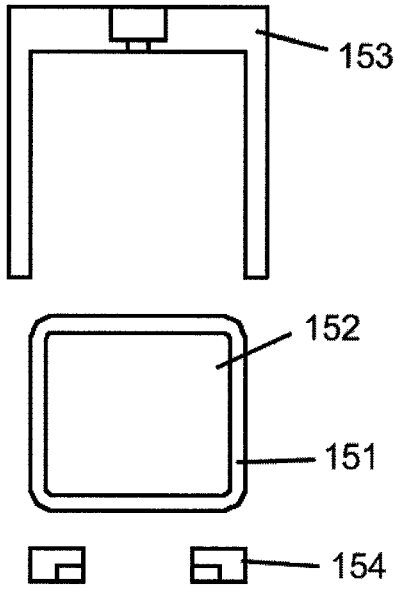
FIGS. 15*a, b* show a burner with a consumable seal.
Figure 15B:
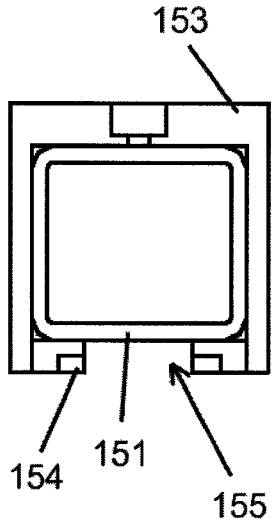

FIGS. 15*a, b* show a burner having a disintegrable seal 151 around a propellant charge 152. The seal may take various structures such as a wax coating which is consumable in nature. A range of compositions and thicknesses of material may be suitable. The charge is confined by casing 153 and a retainer disc or ring 154. An aperture 155 in the disc allows combustion gases to escape after ignition of the propellant 152. However, the nature of the seal and the aperture 155 prevent gases produced external to the burner from disrupting the seal and exposing the propellant to unintended ignition.

Figure 16A:
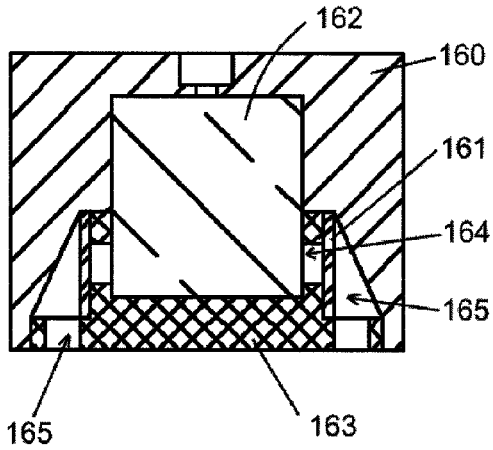
FIGS. 16*a, b* show a burner with a deformable seal.

FIGS. 16*a, b* show a burner having a casing 160 containing a propellant charge 162. A closure 163 completes the casing and includes a series of apertures 164. The seal takes the form of a deformable ring 161 covering the apertures 164. A primer is typically located in a chamber above the charge. On ignition of the charge in FIG. 16*b*, the ring 161 is deformed into an annular space 165 formed outside closure 161 by the shape of the casing, allowing the ignition gases to escape through vents 165 in the closure. The casing may be formed separately or integrally with the projectile.

Figure 16B:
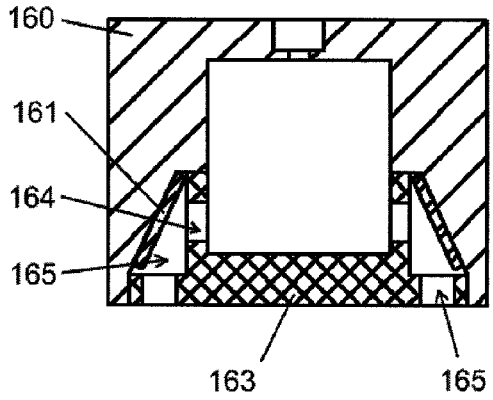

FIG. 16*a* shows an internal sealing system implemented by a deformable annular ringsleeve. The annular ring sleeve is press fitted over the annulus with a generally cylindrical casing with exit vent holes in it. The top and bottom portions of the unit are connected to the projectile via means not shown in this diagram. When the propellant is ignited by the primer the pressure develops inside the unit to the predetermined pressure at which the annular ring is designed to deform outwards and allow expanding propellant gases to vent through the exit vent holes in the annulus. The supporting walls of the upper portion of the unit are angled and positioned appropriately in order that the annular ring deforms only to a predetermined position and is retained. Propellant gases are redirected downwards by the supported angled surface of the deformed annular ring and are typically directed through a further series of vent ports in the lower portion of the unit before entering the barrel and propelling the projectile from the barrel. FIG. 16*b* shows the unit in used state when the annular ring has been deformed. This embodiment of the invention requires only a few parts with just the annular sleeve and the preferably also the outer cylindrical surface over which the sleeve is fitted requiring specific attention during manufacture. Furthermore, should the sleeve fracture it will be retained within the projectile. Another advantage of the deformable sleeve version of this embodiment is the build up to the predetermined pressure resulting in a better gas pressure release profile. The annular chamber defined in part by the angled supporting wall furthermore results in more even venting of gas from the further series of vent ports. The downward or axial direction of the further series of vent ports doesn't direct gases directly onto the bore walls. The gas pressure release profile can be easily varied by simply changing the annular sleeve, whereby the projectile can be easily modified for use with different propellents or for predetermining a different gas release pressure profile.

Figure 17A:
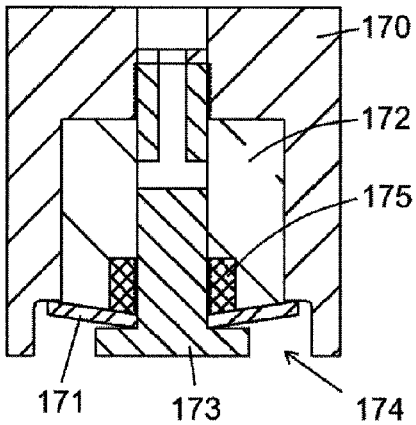
FIGS. 17*a, b, c* show a burner with a moveable seal.
Figure 17B:
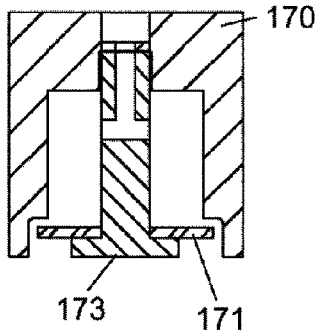
Figure 17C:
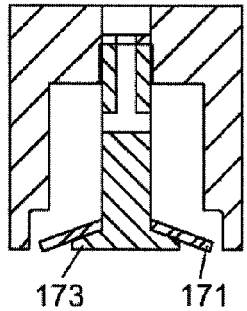

FIGS. 17 *a, b, c* show a burner having a casing 170 containing a propellant charge 172. A closure 173 completes the casing and defines an exit 174 for ignition gases. The seal is a spring loaded or otherwise flexible ring 171 blocking the exit 174. The ring has a generally annular shape made of metal or plastic or other suitable material. In this example the ring has a stable configuration as shown in FIG. 17*a*, with the exit blocked. On ignition of the propellant gases, the ring temporarily adopts an unstable configuration as shown in FIG. 17*b* or 17*c*, with the exit open. Once ignition has taken place, and the pressure of escaping gas is reduced, the ring returns to the stable configuration. A collar 175 may optionally be included to hold the ring in place. These components may be threaded, press fit or otherwise held in place by suitable means.

Figure 18A:
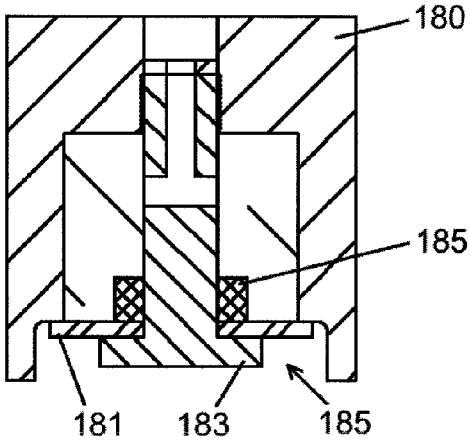
FIGS. 18*a, b* show a burner with a deformable seal.
Figure 18B:
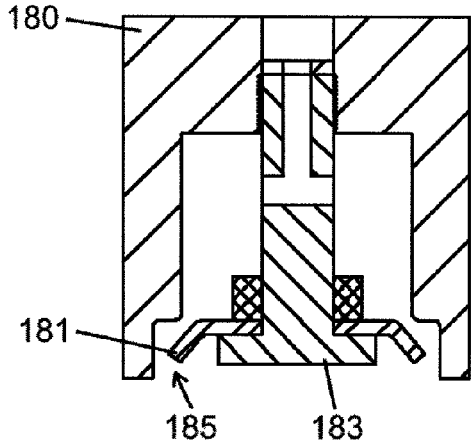

FIGS. 18*a, b* show a burner alternative to FIGS. 17*a, b, c*. A casing 180 and closure 183 form a chamber which holds propellant 182, with an exit 184. In this case the seal is a deformable ring 181 which blocks the exit, optionally held in place by a collar 185. As before the ring has a generally annular shape made of metal or plastic or other suitable material, and preferably formed separately from the other components. On ignition of propellant 182 the ring deforms under gas pressure to a new configuration as shown in FIG. 18*b*, opening the seal.

Figure 19A:
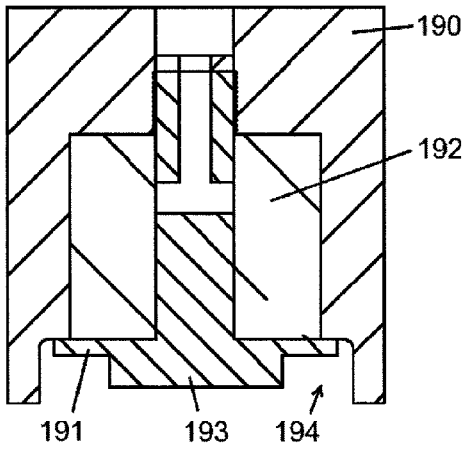
FIGS. 19*a, b* show a burner with a deformable seal.
Figure 19B:
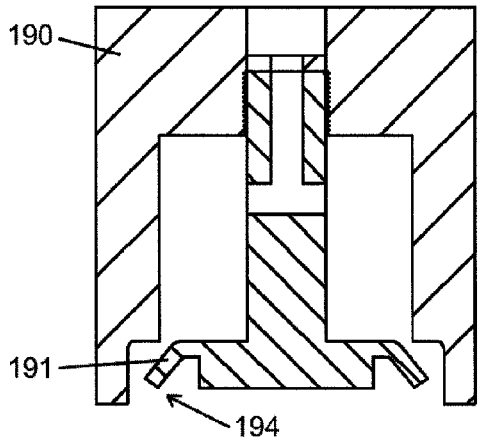

FIGS. 19*a, b* show a variation on the burner in FIGS. 18*a, b*. As before casing 190 and closure 193 form a chamber with an exit 194, containing propellant 192. In this case, the seal is a deformable flange 191 formed integral with the closure 193. On ignition of the propellant, the flange deforms into exit 194 allowing the ignition gases to escape. A collar is unnecessary to hold the seal in place.

Figure 20A:
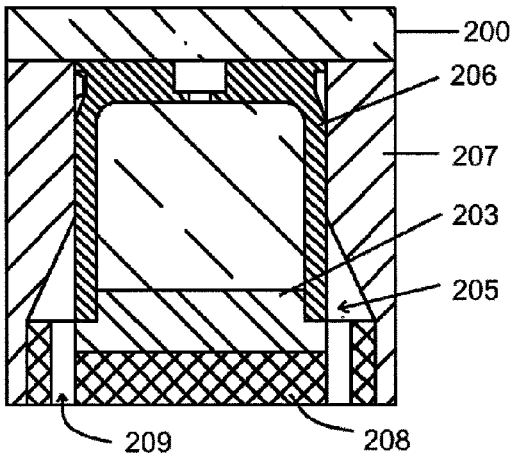
FIGS. 20*a, b* show a burner with a deformable seal.
Figure 20B:
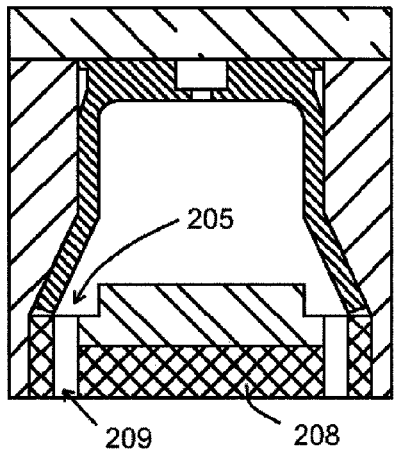
FIGS. 20*c, d* show a projectile with the burner in FIGS. 20*a, b,*

FIGS. 20*a, b* show a burner having a compound casing 200 formed by a generally cylindrical insert 206 surrounded by a shell 207. The insert might be formed from a conventional shell casing while the shell might be formed separately or integrally with the projectile. A closure 203 blocks an otherwise open end of the insert, held in place by a plug 208 containing vents 209. Propellant 202 is contained in the chamber formed by the casing and closure. The insert is deformable in the vicinity of the closure and on ignition of the propellant, as shown in FIG. 20*b*, spreads outwards into an annular space 205 formed by the internal shape of the shell 207. Ignition gases then escape through the vents to fire the projectile fro the barrel.

Figure 20C:
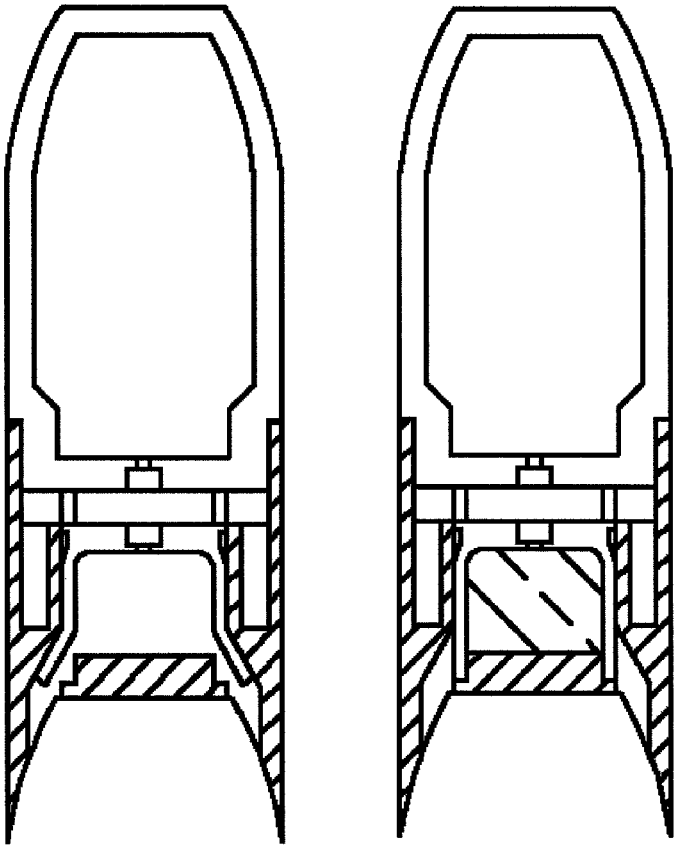
Figure 20D:
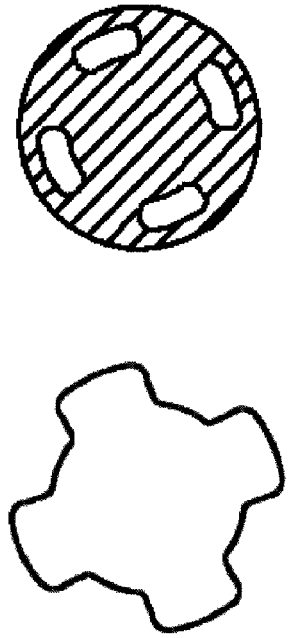

FIGS. 20*c, d* show how a burner based on FIGS. 20*a, b* may be incorporated in a stackable projectile. In this example the closure 203 and plug 208 are integral with the, preferably plastic, tailpiece of the projectile. The casing press fits into the tailpiece from above, and propellant can be loaded into the casing before insertion of the primer. The tailpiece is then engaged with the warhead. FIG. 20*b* is a cross section through the projectile showing the burner sealed with propellant and then after the propellant has been ignited. FIG. 20*d* has corresponding end views of the tailpiece, showing a change in shape of the vents caused by deformation.

Figure 21A:
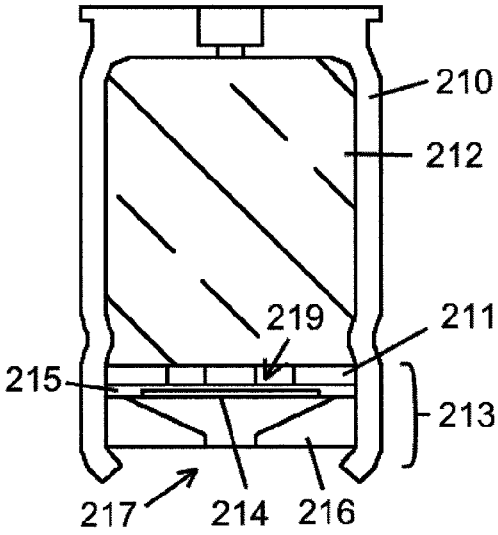
FIGS. 21*a, b* show a burner with a rupturable seal.
Figure 21B:
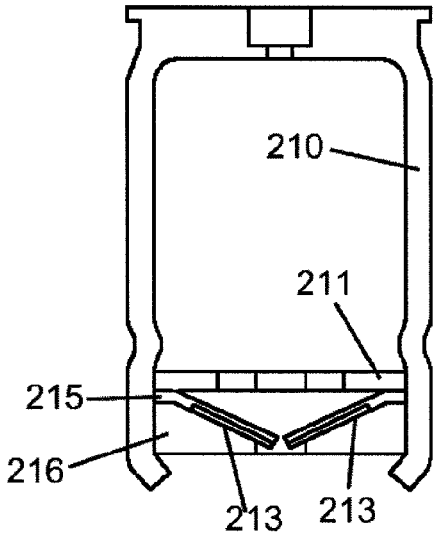

FIGS. 21 *a, b* show a casing 210 and closure 213 containing propellant 212. The closure, as described in respect of, e.g., FIGS. 8 and 9, is formed by a burst disc 215 located beneath a panel 211 with vents 219. As described above for FIGS. 8 and 9, the vent disc 90 may be omitted or may be selected to provide throttling of the propellant gases being vented. A retainer disc 216 holds the burst disc and the panel in place within the casing. The casing may be formed from a conventional shell, for example, with the otherwise open end 217 of the casing being crimped to confine the retainer disc. On ignition of the propellant, a seal formed by the burst disc is opened by deformation to release ignition gases through the vents. Ruptured portions 213 of the burst disc are urged outward and are confined by the internal shape of the retainer disc. The burst disc may be weakened in a central region 214, or using an alternative pattern, to enable and control the rupture. As described above for FIG. 9, the diameters and slope of the inner edge of the retainer disc 216 are varied to achieve a desired rupture and subsequent throttling for the propellant gases.

The inner diameter of the slope of retainer disc 216 of FIG. 21 is part way through the thickness of the disc 216. This design provides a more robust retainer for both during firing and assembly and may be incorporated into the burner of e.g. FIGS. 8 and 9.

Figure 22A:
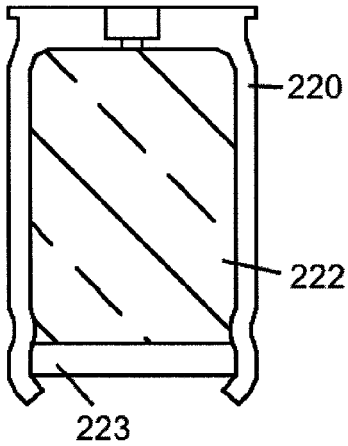
FIGS. 22*a, b, c* show a burner with a deformable seal.
Figure 22B:
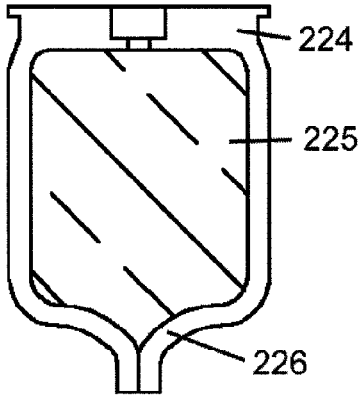
Figure 22C:
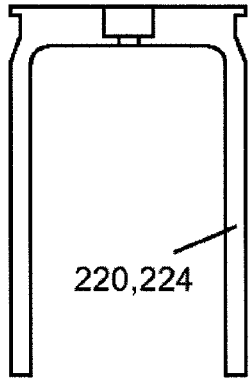
Figure 23A:
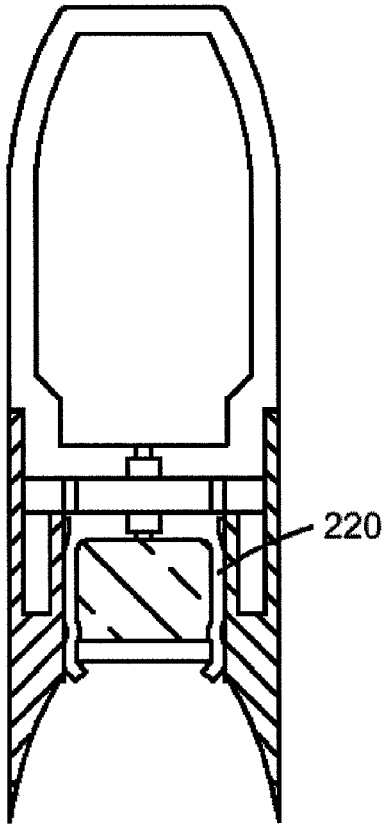
FIGS. 23*a, b* show a projectile with the burner of FIGS. 22*a,b,*
Figure 23B:
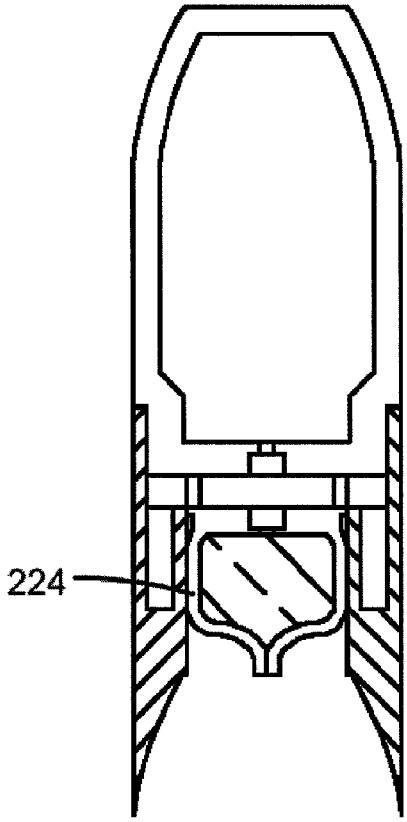

FIG. 22*a* shows an alternative casing 220 with a simple closure 223, containing propellant 222. The otherwise open end of the casing is crimped to confine the closure which preferably disintegrates on ignition of the propellant. FIG. 22*b* shows a further alternative casing 224 which is simply deformed at the otherwise open end 226 to contain the propellant 225, and does not require a separate closure. FIG. 22*c* shows the open form of these casings after ignition of their respective propellant. FIGS. 23*a, b* show how burners formed according to FIGS. 22*a, b* respectively may be located in stackable projectiles.

Figure 24:
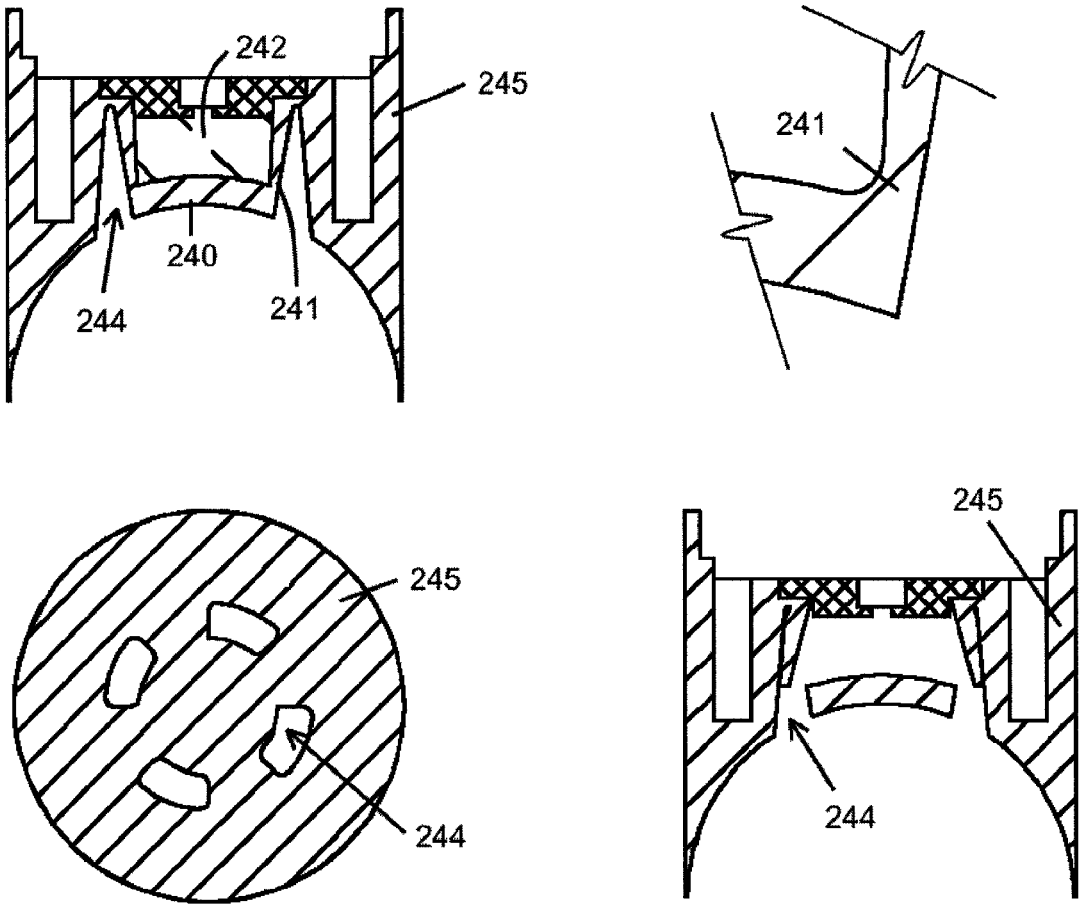
FIG. 24 shows a tailpiece including a rupturable seal.

FIG. 24 shows how a rupturable burner alternative to FIGS. 13*a, b, c* may be formed. In this example the burner is integral with a tailpiece 245 for the projectile. The casing 240 contains propellant 242 and includes rupture portions 241. Each portion is formed by a relatively thin corner 243 which ruptures under pressure caused by ignition gases. Outside the rupture portions the tailpiece includes vents 244. On ignition of the propellant the rupture portions are opened and deform into the volume available in the vents, but leaving an exit for escape of the gases. As before, ignition gases released by other projectiles in a stack remain outside the casing and do not affect the rupture portions.

Figure 25:
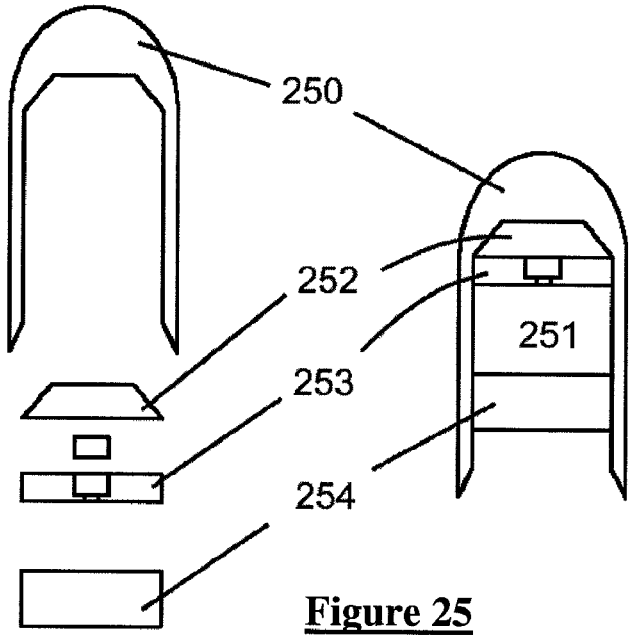
FIG. 25 shows an alternative projectile.

FIG. 25 shows a further stackable projectile as a non-explosive smaller calibre alternative to the projectile of FIG. 1. These projectiles are also intended to be loadable and if necessary unloadable in the field. In this example, the projectile has an integral outer casing 250 which contains propellant 251, an inductor and detector system 252, primer and retaining ring 253 actuated by the detector system, and a sealing valve 254 shown in schematic form. The valve may take a variety of structures based on those shown above.

Figure 26A:
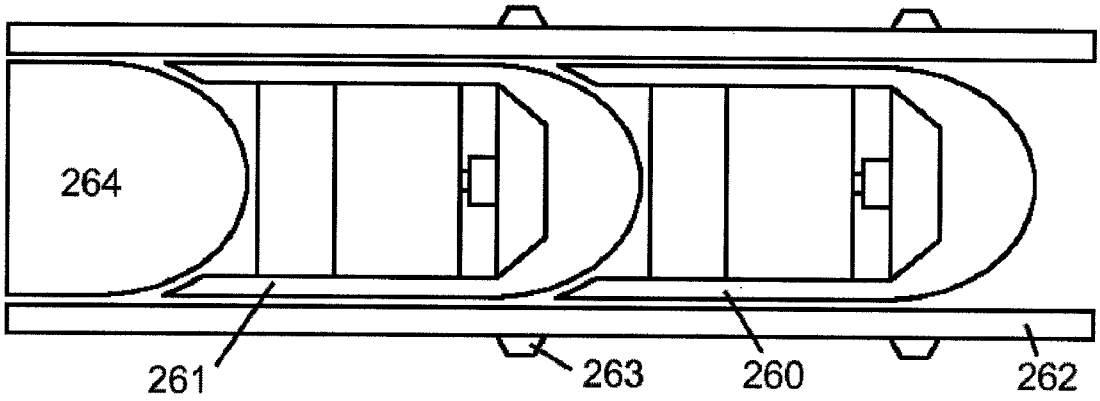
FIGS. 26*a, b* show stacking of the projectile in FIG. 25.
Figure 26B:
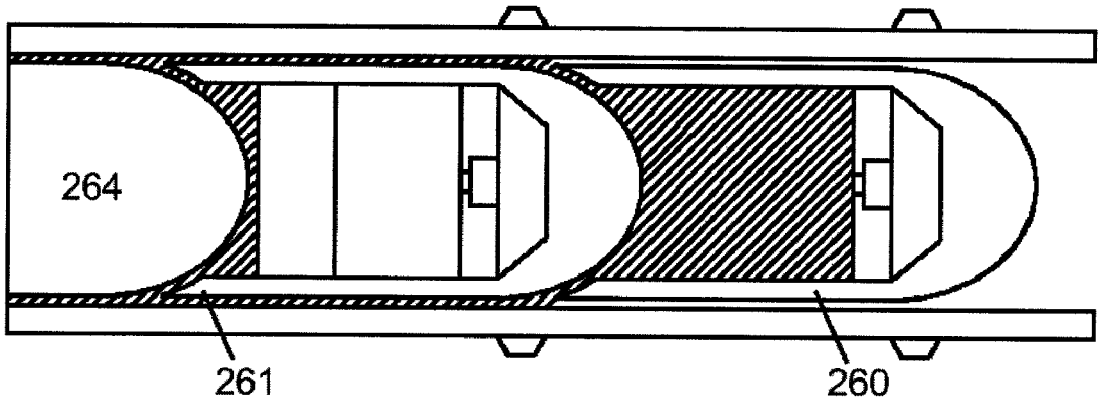

FIGS. 26*a, b* show how the projectile in FIG. 25 may be stacked. Projectiles 260 and 261 are leading and trailing projectiles respectively, stacked nose to tail in barrel 262. Inductors 263 outside the barrel interact with inductors in the projectiles to initiate the firing process. A breech plug 264 supports projectile 261 at the base of the stack. The projectiles generally have a sliding fit within the bore of the barrel, and usually include driving bands, but there is generally enough tolerance within the bore of the barrel for hot, high pressure propellant gas from a leading projectile to circulate past trailing projectiles when the leading projectile is fired. In FIG. 26*b* the gas (shaded) from ignition of propellant in the burner of projectile 260 blows backwards down the barrel past projectile 261. Without sealing, there is a tendency for ignition of the propellant in projectile 261. Conventional forms of sealing such as nose to tail wedging may also be employed.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the following claims.

What is claimed is:

1. A projectile for use in a barrel with a plurality of stacked projectiles, including:

a chamber containing a propellant charge for the projectile, the chamber including a sealing surface, an exit from the chamber for release of propulsion gases into the barrel when the propellant is ignited to fire the projectile, a deformable seal blocking the exit by sealing against the sealing surface of the chamber, wherein the seal is opened by ignition of the propellant within the chamber but is resistant to propulsion gases from other projectiles in the barrel, and is forced further into engagement with the sealing surface by pressure from propulsion gases from other projectiles in the barrel, and a retainer engaging the seal into engagement with the sealing surface, wherein the seal is ruptured by ignition of the propellant within the chamber along lines of weakness formed by grooves on a surface of the seal external to the chamber.

2. A projectile according to claim 1 wherein the lines of weakness are configured to form a throttle.

3. A projectile according to claim 1 wherein the cross sectional shape of the lines of weakness include radiuses.

4. A projectile according to claim 1 wherein the lines of weakness include two or more intersecting grooves.

5. A projectile according to claim 4 wherein the lines of weakness are equal in length and bisect each other to form leaves.

6. A projectile according to claim 1 wherein the retainer is a separate component and engages the chamber within the exit.

7. A projectile according to claim 1 wherein the retainer is a separate component and engages with the chamber external to the exit.

8. A projectile according to claim 1 wherein the retainer is annular and propulsion gases pass through the retainer.

9. A projectile according to claim 1 wherein the seal is a disc.

10. A projectile according to claim 1 wherein the retainer is a separate component and engages with the chamber by a threaded engagement.

11. A projectile according to claim 10 wherein the retainer includes slots or a hexagonal surface for engaging a tool for advancing the threaded engagement.

* * * * *